US006328354B1

(12) United States Patent
Dejean et al.

(10) Patent No.: US 6,328,354 B1
(45) Date of Patent: Dec. 11, 2001

(54) LOCK FOR RIGHT OR LEFT DOOR OF AN AUTOMOBILE VEHICLE

(75) Inventors: Philippe Dejean, Amiens; Patrick Dupont, Nolette; Jean-Michel Roncin, Abbeville, all of (FR)

(73) Assignee: Valeo Securite Habitacle (FR)

( * ) Notice: Subject to any disclaimer, the term of this patent is extended or adjusted under 35 U.S.C. 154(b) by 0 days.

(21) Appl. No.: 09/449,721

(22) Filed: Nov. 24, 1999

(30) Foreign Application Priority Data

Nov. 26, 1998 (FR) ..... 98 14892

(51) Int. Cl.[7] ..... E05C 3/06
(52) U.S. Cl. ..... 292/216; 292/116; 292/213
(58) Field of Search ..... 292/216, DIG. 23, 292/116, 213

(56) References Cited

U.S. PATENT DOCUMENTS

| | | | | |
|---|---|---|---|---|
| 2,795,448 | * | 6/1957 | Johnson | 292/216 |
| 3,858,916 | * | 1/1975 | Torii | 292/45 |
| 4,679,836 | | 7/1987 | Pulillo et al. . | |
| 4,835,997 | * | 6/1989 | Akright | 70/141 |
| 4,838,588 | * | 6/1989 | Hayakawa | 292/216 |
| 5,221,115 | * | 6/1993 | Takimoto | 292/29 |
| 5,618,069 | | 4/1997 | Konchan et al. . | |
| 5,746,457 | * | 5/1998 | Kim | 292/216 |
| 6,012,747 | * | 1/2000 | Takamura | 292/216 |

FOREIGN PATENT DOCUMENTS

| | | |
|---|---|---|
| 195 45 722 | 4/1997 | (DE) . |
| 1 411 469 | 10/1975 | (GB) . |

OTHER PUBLICATIONS

French Search Report dated Jul. 28, 1999.

* cited by examiner

*Primary Examiner*—Gary Estremsky
(74) *Attorney, Agent, or Firm*—Morgan & Finnegan, LLP

(57) ABSTRACT

The disclosure relates to a door lock for an automobile vehicle, including a lock casing with at least two compartments, the first being a retention compartment containing retention parts, such as a latch bolt intended to engage and hold a striker, and a pawl intended to block the latch bolt in its striker holding position, and the second being a kinematic compartment containing parts used to control the inside and outside opening and locking/unlocking of the lock, the compartments providing, for the retention and control parts, mounting planes parallel to the transverse vertical plane of the vehicle, said retention compartment including a striker slot opening in the transverse direction and receiving a striker during door closing, wherein said casing has a plane of symmetry parallel to the longitudinal vertical plane or to the longitudinal horizontal plane of the vehicle, to enable use of the same casing for either a left door or a right door.

11 Claims, 4 Drawing Sheets

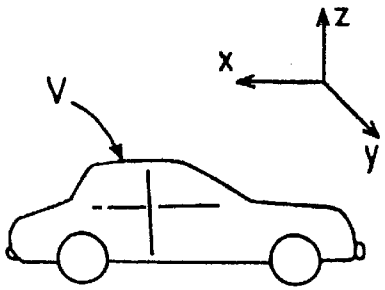
FIG.1
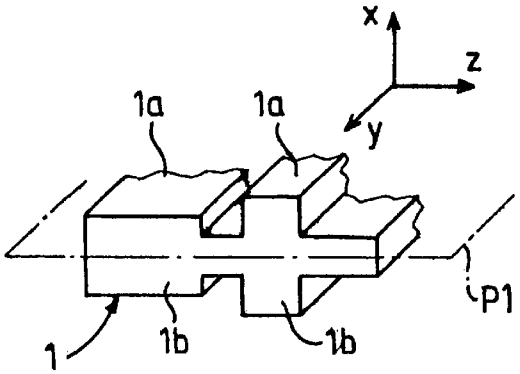
FIG.2
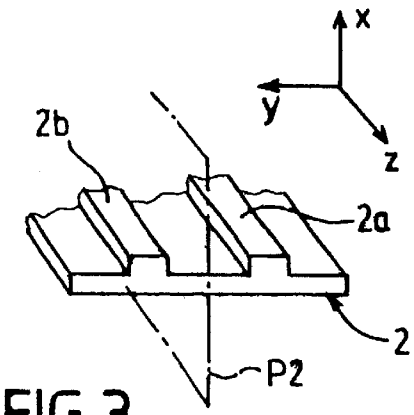
FIG.3
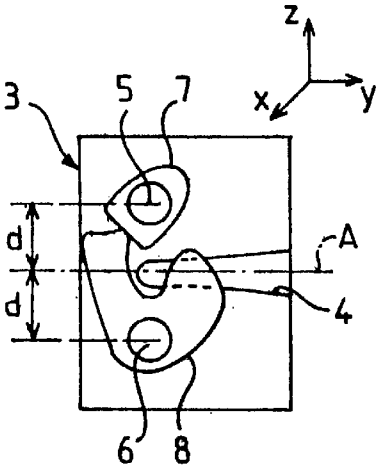
FIG.4
FIG.5
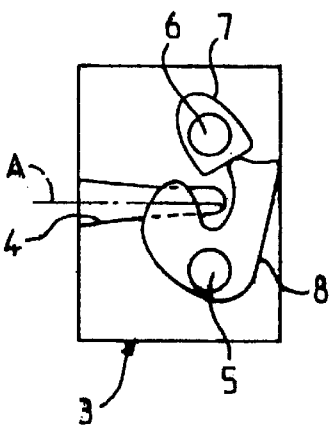
FIG.6
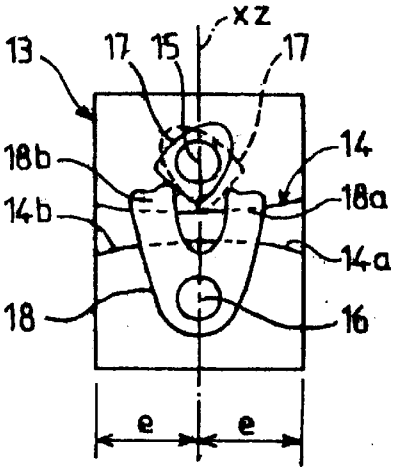
FIG.7

LOCK FOR RIGHT OR LEFT DOOR OF AN AUTOMOBILE VEHICLE

BACKGROUND OF THE INVENTION

The invention concerns an automobile vehicle door lock using an electrical or mechanical control for opening and locking/unlocking.

FIG. 1 shows an automobile vehicle V whose longitudinal direction is labeled X, the transverse direction Y and the vertical direction Z. The lock is generally mounted in the rear edge of a door, the edge lying in a plane substantially parallel to the vertical transverse plane YZ of the vehicle, when the door is closed.

DESCRIPTION OF THE PRIOR ART

Vehicle door locks generally include a lock casing with at least two compartments. One is the so-called retention compartment containing retention parts, such as a latch-bolt intended to engage and hold a striker, and a pawl used to block the latch-bolt in its striker-holding position. Another compartment is the so-called kinematic compartment containing parts that control the inside and outside opening and locking/unlocking of the lock. The compartments define, for said parts, mounting planes parallel to the plane YZ. The retention compartment includes a tapered striker slot opening notably in the Y direction towards the inside of the vehicle; as the door closes this slot receives a striker fixed to the structure of the vehicle, notably to a door pillar.

It is then necessary to manufacture lock casings and parts that are different for left doors and right doors, which increases the total number of parts necessary to make all the locks of a vehicle, and thereby the overall cost of the locks.

SUMMARY OF THE INVENTION

The object of the invention is to propose a lock for automobile vehicle doors that can be used for both left doors and right doors.

For this purpose, the object of the invention is a lock for the door of an automobile vehicle, including a lock casing with at least two compartments, the first being a so-called retention compartment containing retention parts, such as a latch-bolt intended to engage and hold a striker, and a pawl intended to block said latch-bolt in its striker-holding position, and the second being a so-called kinematic compartment containing parts used to control the inside and outside opening and locking/unlocking of the lock, said compartments providing, for said retention and control parts, mounting planes parallel to the vertical transverse plane YZ of the vehicle, said retention compartment including a striker slot opening in the transverse direction Y and receiving a striker during door closing, wherein said casing has a plane of symmetry parallel to the longitudinal vertical plane XZ or to the longitudinal horizontal plane XY of the vehicle, to enable use of the same casing for either a left door or a right door.

It is advantageous that most of the parts of the lock, or even all the parts, have a plane of symmetry parallel or perpendicular to their mounting plane, to enable use of the same parts in either a left door or a right door.

In a first embodiment, the lock casing has a plane of symmetry in XY that passes through the axis of the striker slot which enables use of the same casing for a left door or a right door, by rotating the casing through 180° about an axis parallel to the longitudinal direction X of the vehicle.

In this case, the articulation axes of the latch-bolt and the pawl in the retention compartment of the casing can be made symmetrical with respect to the axis of the striker slot so that they can be inverted with respect to said axes and therefore be fitted in a left or right door lock.

It is also possible to provide articulation axes and apertures in the casing allowing displacement of control parts that are symmetrical with respect to the plane of symmetry XY of the casing, since this enables said parts to be mounted on either side of said plane of symmetry, depending on whether the lock is intended for a left door or a right door.

In another embodiment, the lock casing has a plane of symmetry in XZ, the striker slot opening in the Y direction towards the two opposite sides of the casing, to enable the casing to be mounted in the same position, whether the lock is intended for a left door or a right door.

In this case, the articulation axes of the latch-bolt and the pawl in the retention compartment of the casing can lie in the plane of symmetry of the casing, enabling the latch-bolt and the pawl to remain mounted on their respective axes, whether the lock is intended for a left door or a right door.

According to another characteristic of the invention, at least one of said parts, for example the latch-bolt, the pawl or a lock actuator, has a plane of symmetry perpendicular to its mounting plane, to enable use of the same part in a left door lock or a right door lock, by rotating the part through an angle between 0° and 180° about an axis parallel to the X direction.

In this case, the latch-bolt can be fork-shaped with two branches symmetrical with respect to its plane of symmetry that passes through the axis of rotation of the latch-bolt. The pawl can be anchor-shaped with two lateral notches symmetrical with respect to its plane of symmetry that passes through the axis of rotation of the pawl. The lock actuator can have two arms that extend substantially perpendicularly and symmetrically with respect to the plane of symmetry of the casing, this plane passing through the axis of rotation of the lock actuator.

Another characteristic of the invention is that at least one of the parts, for example the latch-bolt, the pawl, an outside opening lever, a lock actuator, an outside locking lever or a pawl maneuvering part, has a plane of symmetry parallel to its mounting plane, to enable use of the same part in a left door lock or a right door lock, by rotating said part through an angle of 180° about an axis parallel to the Y or Z direction.

It is advantageous that the casing be mounted on an L-section metal backplate whose large face lies substantially in a plane parallel to the mounting plane YZ mentioned previously and whose small face lies substantially in a plane parallel to the longitudinal vertical plane XZ of the vehicle, at the end of the striker slot, said backplate having the same plane of symmetry as the casing.

BRIEF DESCRIPTION OF THE DRAWINGS

Other characteristics and advantages of the invention will become clear on reading the description below of several embodiments, given only as non-limitative examples, making reference to the attached drawings of which:

FIG. 1 is a schematic side view of an automobile vehicle;

FIG. 2 is a partial perspective view of a part having a plane of symmetry parallel to its mounting plane in YZ;

FIG. 3 is a partial perspective view of a part having a plane of symmetry perpendicular to its mounting plane;

FIG. 4 is a schematic view in plane of the retention compartment of a lock corresponding to a first embodiment of the invention, intended for a left door, and whose casing has a plane of symmetry in XY;

FIG. 5 is a view similar to that in FIG. 4, after inversion of the mountings of the latch-bolt and pawl, and rotating of the latch-bolt and pawl through 180° about a Y axis;

FIG. 6 is a view similar to that in FIG. 5, after rotating of the lock casing through 180° about an X axis, corresponding to a lock for a right door;

FIG. 7 is a view similar to that in FIG. 4, but showing a casing having a plane of symmetry in XZ, and a pawl and latch-bolt having a plane of symmetry perpendicular to their mounting plane;

DETAILED DESCRIPTION

Figure 10:
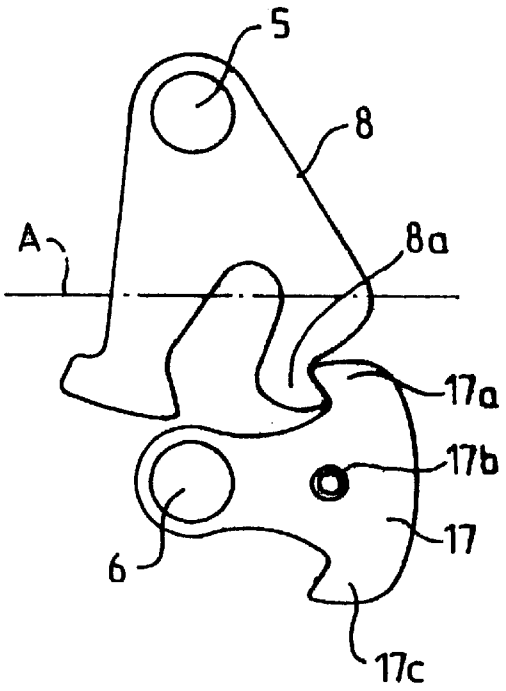
FIG. 10 is a view similar to that of FIG. 9, but showing the latch-bolt a the pawl after inversion of their mounting positions on their respective axes.

FIG. 2 shows a part 1 that is substantially flat and has ribs 1*a* on its upper face and ribs 1*b* on its upper surface, these ribs 1*a* and 1*b* being symmetrically positioned with respect to a plane P1. The plane P1 is the median plane of the part 1 passing through its mounting plane, for example a plane parallel to the vertical transverse plane YZ of the vehicle V. The part 1 is therefore in the form of a double-faced part, each facing being the inverted image of the other face.

FIG. 3 shows a substantially flat part 2 that has a rib 2*a* and a rib 2*b*, these ribs 2*a* and 2*b* being symmetrically positioned with respect to a plane P2. The plane P2 is perpendicular to the mounting plane of the part 2, for example parallel to a longitudinal vertical plane XZ, as shown in FIG. 3. The plane P2 could also be parallel to a longitudinal horizontal plane XY of the vehicle V.

FIGS. 4 to 6 show a lock whose casing 3 has a plane of symmetry perpendicular to its mounting plane, which is a plane parallel to the plane XY of the vehicle. The axis A of the striker slot 4 of the casing 3 extends in the direction Y and lies in the plane of symmetry XY of the casing. In addition, the articulation axes 5 and 6 of a pawl 7 and a latch-bolt 8 respectively, are parallel and lie the same plane parallel to the plane XZ of the vehicle. The axes 5 and 6 both lie at a distance d from axis A of the striker slot. The lock shown in FIG. 4 is intended to a left side door of the vehicle V.

To change to a lock destined for a right side door, the mounting positions of the pawl 7 and the latch-bolt 8 on the axes 5 and 6 are inverted, as shown in FIG. 5. In this case, the latch-bolt 8 articulates on the axis 5 and the pawl 7 articulates on the axis 6. In addition, the pawl 7 and the latch-bolt 8 are symmetrical in the sense of FIG. 2, in other words they have a plane of symmetry parallel to their mounting plane which is a plane in YZ. Consequently, these parts can be turned over onto their opposite face by rotating through an angle of 180° about an axis parallel to the Y direction, as in FIG. 5.

For a right door, the casing 3 is also turned through 180° about an axis parallel to the X direction, as shown in FIG. 6, such that the striker slot 4 opens in the opposite direction to that shown in FIG. 4. In this manner a left-hand door lock and a right-hand door lock both use the same casing and the same components in the retention compartment of the lock. It would be possible, of course, to turn the casing first, then invert the mounting of the pawl and latch-bolt.

FIG. 7 represents another embodiment of the lock that includes a casing 13 having a plane of symmetry perpendicular to its mounting plane, which is here a plane parallel to the plane XZ of the vehicle. In this case, the striker slot 14 includes two parts 14*a* and 14*b* that open in the Y direction on each side of the casing. In addition, the axes of rotation 15 and 16 of the pawl 17 and the latch-bolt 18 respectively, are parallel with each other and lie in the plane XZ, such that the distance e between said axes 15 and 16 and each lateral edge of the casing is identical.

In the position of the pawl 17 shown as a solid line in FIG. 7, the lock is intended for a left door. The striker is intended to cooperate with the latch-bolt 18 by passing through the part 14*a* of the striker slot 14. When the door is closed, the pawl 17 blocks the branch 18*b* of the forked latch-bolt 18, preventing it from pivoting clockwise to its position when the door is open.

To change to a lock intended for a right door, the casing 13 is placed in the same position in the edge of the right door. In this case, the striker is intended to cooperate with the latch-bolt 18 by passing through the part 14*b* of the striker slot 14, and the pawl 17 is in the position shown as a dashed line where is blocks the other branch 18*a* of the forked latch-bolt 18.

In FIG. 7, the latch-bolt 18 and the pawl 17 have a plane of symmetry perpendicular to their mounting plane, to enable use of the same pawl and the same latch-bolt in either a left door lock or a right door lock, without inverting their mounting face but simply pivoting the pawl and latch-bolt around the X axis. In particular, the forked latch-bolt 18 here has two branches 18*a*, 18*b* that are positioned symmetrically with respect to a plane perpendicular to the mounting plane and passing through the axis of rotation 16 of the latch-bolt.

Figure 8:
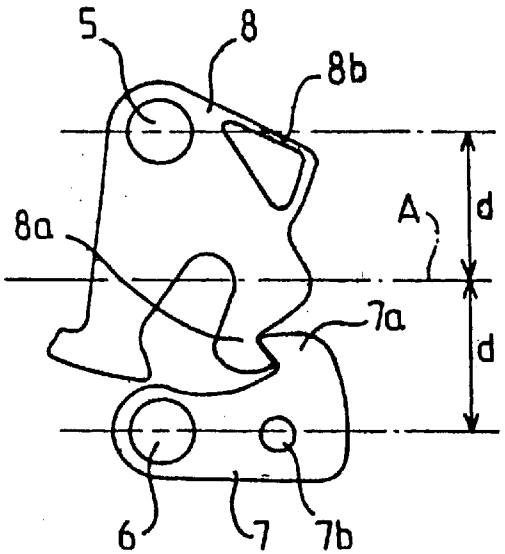
FIG. 8 is a plan view of a latch-bolt and a pawl whose shapes are suitable for use in a lock corresponding to FIG. 4.

FIG. 8 shows a special form of the latch-bolt 8 and the pawl in the intermediate position corresponding to FIG. 5. The pawl 7 includes on one side a hook 7*a* that is intended to hold a matching notch 8*a* on one of the branches of the forked latch-bolt 8. The latch-bolt 8 also includes a lateral projection 8*b* and the pawl has a bore 7*b* whose purposes will be explained with reference to FIG. 11.

Figure 9:
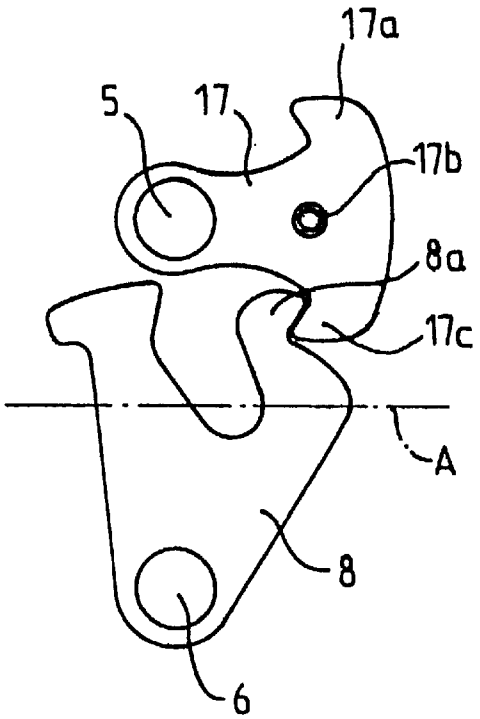
FIG. 9 is a plan view of a latch-bolt and a pawl in a variant of an embodiment, for a left door lock whose casing has a plane of symmetry in XY.

In the variant of the embodiment shown in FIGS. 9 and 10, the latch-bolt 8 does not have the projection 8*b*. The pawl 17 is anchor-shaped with two hooks 17*a*, 17*c* on its two opposite sides, positioned symmetrically with respect to a plane perpendicular to its mounting plane and passing through its axis of rotation. The pawl 17 also includes a projecting stud 17*b* lying in the plane of symmetry of the pawl; its function will be explained with reference to FIGS. 12 and 13.

To change from the left door mounting position shown in FIG. 9 to the intermediate position represented in FIG. 10, the pawl 17 and the latch-bolt 8 are mounted by inverting their axes of rotation; the latch-bolt 8 is turned over, due to its symmetry parallel to its mounting plane, whereas the pawl 17, that has a symmetry perpendicular to its mounting plane, is not turned over. The hook 17*a* of the pawl 17 then engages the notch 8*a* of the latch-bolt 8, whereas in the position of FIG. 9 the hook 17*c* of the pawl 17 engages the notch 8*a* of the latch-bolt 8.

Figure 11:
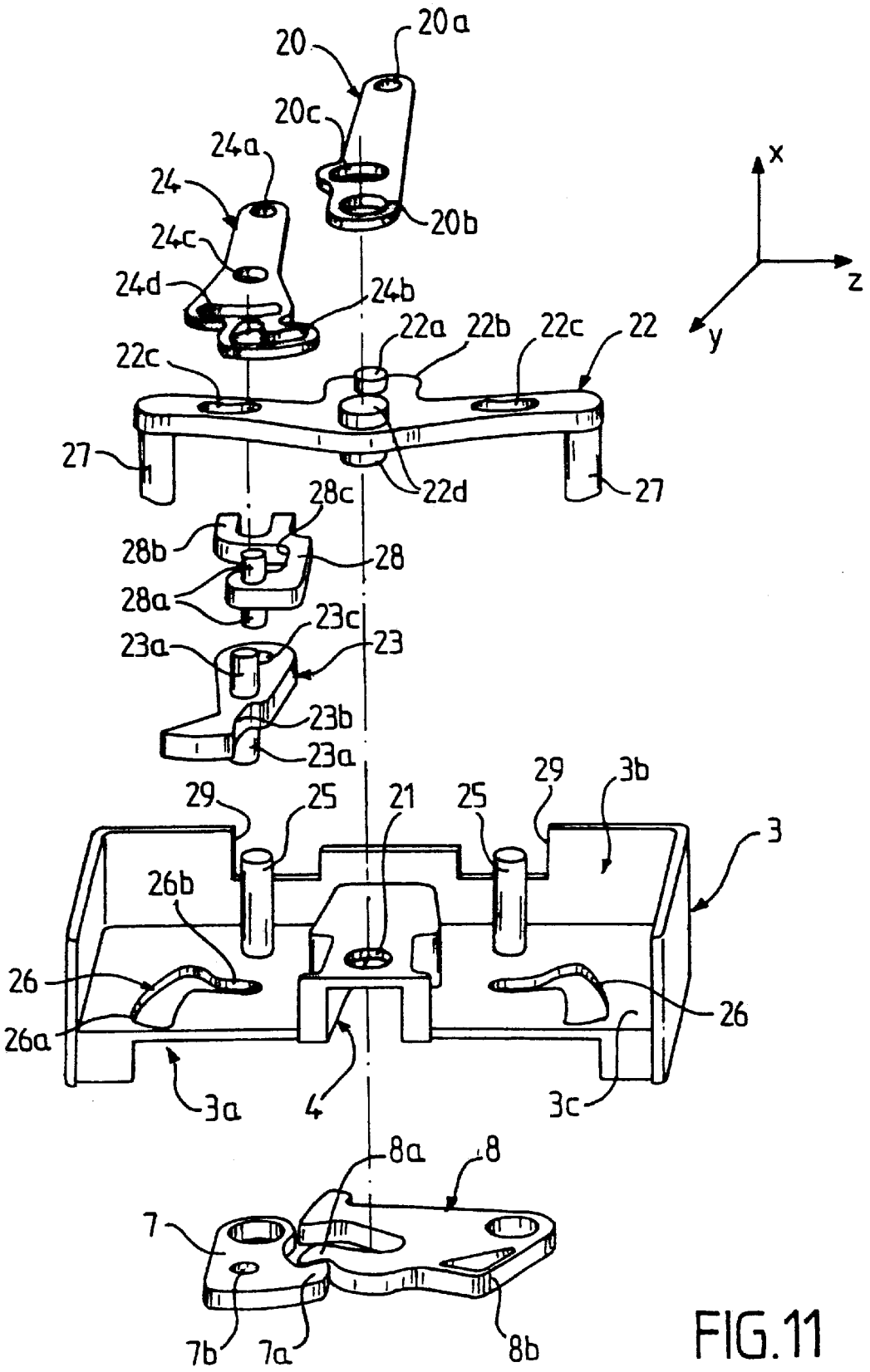
FIG. 11 is an exploded perspective view of a variant of a lock according to the invention, equipped with the latch-bolt and pawl of FIG. 8.

In FIG. 11, we see that the casing 3 defines a first compartment known as the "retention" compartment 3*a* that houses the pawl 7 and the latch-bolt 8, which are identical to those in FIG. 8, and a second so-called "kinematic" compartment 3*b* that houses the control parts of the lock. The two compartments 3*a* and 3*b* are separated by a transverse partition 3*c* that lies in a plane YZ. The retention compartment 3*a* is closed by a metal backplate of known design (not shown). The kinematic compartment 3*b* is covered by a lid or by another casing containing electric drive motors when the lock has an electrical opening and/or locking control.

The kinematic compartment 3*b* of the casing 3 contains an outside locking lever (OLL) 20 of which one end 20*a* projects outside the casing where is cooperates with a lock cylinder (not shown) for mechanical locking/unlocking of the lock. At its other end, the OLL 20 includes a hole 20*b* that is intended to align with a hole 21 in the bottom 3*c* of the casing 3, next to the striker slot 4, and lying in the plane of symmetry XY of the casing. The kinematic compartment 3*b* also contains a lock actuator 22 that has a projecting stud 22*a* on its face opposite the bottom 3*c* of the casing 3, said stud 22*a* being intended to fit in a circular arc-shaped hole 20*c* in the OLL 20, to make the OLL 20 and the lock actuator 22 rotate together, with a slight degree of freedom, for reasons given later. The lock actuator 22 can include, at its center and near the stud 22*a*, a toothed sector 22*b* that engages a pinion driven by an electric motor, in the case of a lock with electrical locking/unlocking control. The lock actuator 22 includes two arms extending in opposite directions, symmetrically with respect to the plane of symmetry XY passing through the stud 22*a*, each arm having a circular arc-shaped hole 22*c* and, at its end free, a projecting stud 27 that extends to the bottom 3*c* of the casing 3. Each projecting stud 27 is intended to penetrate an aperture 26 provided in the bottom 3*c* of the casing 3, on each side of its plane of symmetry. Each aperture 26 comprises two sections 26*a* and 26*b*, both circular arc-shaped, that extend substantially at right angles to each other. Each stud 27 is intended to move in the widest section 26*a*.

The circular arc-shaped hole 22*c* of the lock actuator 22 is provided to receive a projecting stud 28*a* of an intermediate lever 28, this stud 28*a* extending on each side of the plane of the intermediate lever 28, to enable it to be turned over for a right door lock. At the end opposite the double-ended stud 28*a*, the intermediate lever 28 includes a fork 28*b* that engages an articulation axis 25 projecting perpendicularly from the bottom 3*c* of the casing 3, inside the kinematic compartment 3*b*. This articulation axis 25 is duplicated in the casing 3, the two axes 25 being positioned symmetrically with respect to the plane of symmetry XY of the casing.

A dummy pawl 23 is inserted between the bottom 3*c* of the casing 3 and the intermediate lever 28. This dummy pawl 23 has a bore 23*c* to enable it to be fitted on the articulation axis 25. The dummy pawl 23 also has a projecting stud 23*a* located symmetrically with respect to its mounting plane. This stud 23*a*, pointing towards the bottom 3*c* of the casing 3, is intended to penetrate the circular arc-shaped section 26*b* of the aperture 26 mentioned previously, so as to engage the bore 7*b* in the pawl 7, to move it between its of blocking and freeing positions of the latch-bolt 8. Given that the stud 23*a* also projects in the direction away from the casing 3, it is necessary to provide on the intermediate lever 28 a C-shaped recess 28*c* so that the intermediate lever does not interfere with this stud 23*a* on the dummy pawl 23. The stud 28*a* of the intermediate lever 28, which projects towards the casing 3, is intended to come into contact with a face 23*b* of the dummy pawl 23 to make it pivot around the articulation axis 25.

An outside opening lever (OOL) 24 is interposed between the intermediate lever 28 and the lock actuator 22. The OOL 24 is intended to be connected by a control rod or cable (not shown) to an outside door handle (not shown), by its end 24*a* which projects from the casing 3 through a slot 29 that is positioned symmetrically with respect to the plane of symmetry of the casing. The OOL 24 has a bore 24*c* to enable it to be fitted on the articulation axis 25 mentioned previously. At its opposite end, the OOL 24 includes a substantially L-shaped aperture 24*b* which is penetrated by the stud 28*a* projecting from the intermediate lever 28. The OOL 24 also includes a circular arc-shaped aperture 24*d* which is penetrated by the stud 23*a* on the dummy pawl 23 to avoid any interference between this stud 23*a* and the OOL 24.

The lock actuator 22 includes at its center a projecting spigot 22*d* that extends on each side of its plane and whose ends fit respectively the hole 20*b* of the OLL 20 and the hole 21 of the casing 3, to provide an axis of rotation both for the lock actuator 22 and the OLL 20.

The operation of the lock illustrated in FIG. 11 will now be briefly explained.

In the locked position of the lock, the lock actuator 22 is turned anti-clockwise so that its stud 27, situated on the right in FIG. 11, moves to the intersection of the two sections 26*a* and 26*b* of the aperture 26. Simultaneously, the circular arc-shaped hole 22*c* on the opposite arm of the lock actuator 22, moves the upper stud 28*a* of the intermediate lever 28 into the section of the L-shaped aperture 24*b* of the OOL 24 that extends substantially over a circular arc centered on the axis 25. Therefore, when the user operates the outside handle of the door, to pivot the OOL 24 clockwise around the articulation axis 25, the stud 28*a* of the intermediate lever 28 slides freely in the aperture 24*b*, making the OOL 24 inoperative.

To unlock the lock, the user can use his key to turn the lock cylinder, making the OLL 20 pivot clockwise. The pivoting of the OLL 20 moves the lock actuator 22 clockwise, thanks to the engagement of the stud 22*a* in the elongated hole 20*c* of the OLL 20. The hole 20*c* is made elongated to enable automatic return of the OLL 20 to its original position, under the return spring action of the lock cylinder. When pivoting the lock actuator clockwise, the circular arc-shaped hole 22*c* causes linear displacement of the stud 28*a* of the intermediate lever 28 in the other section of the L-shaped aperture 24*b*, that extends substantially radially to the axis 25, this linear displacement being possible thanks to the fork 28*b* of the lever 28 that engages the articulation axis 25. We also note that the stud 27, located on the right of FIG. 11, is now displaced to the end free of the section 26*a* of the aperture 26 of the casing 3.

Consequently, when the user operates the outside door handle, the OOL 24 can drive the stud 28*a* of the intermediate lever 28, since this is engaged in the L-shaped aperture 24*b*. The clockwise pivoting of the lever 24 causes clockwise pivoting of the intermediate lever 28, the upper stud 28*a* of the intermediate lever 28 moving freely in the circular arc-shaped hole 22*c* of the lock actuator 22. Simultaneously, the lower stud 28*a* of the intermediate lever 28 comes into contact with the face 23*b* of the dummy pawl 23 and makes it pivot clockwise. The lower stud 23*a* of the dummy pawl 23 simultaneously causes clockwise rotation of the pawl 7, which frees the latch-bolt 8.

When the latch-bolt 8 moves to its open position, the projection 8*b* partially obstructs the section 26*a* of the aperture 26, thus preventing the stud 27 of the lock actuator 22 from returning to its locked position. In this way locking interdiction is achieved when the door is open.

To change from a left door lock to a right door lock, the lock actuator 22 is retained in the same position, owing to its plane of symmetry perpendicular to its mounting plane. The OOL 24, the OLL 20, the intermediate lever 28 and the dummy pawl 23 are turned over, thanks to their plane of symmetry parallel to their mounting plane. The OOL 24, the intermediate lever 28 and the dummy pawl 23 are then mounted on the other articulation axis 25.

Figure 12:
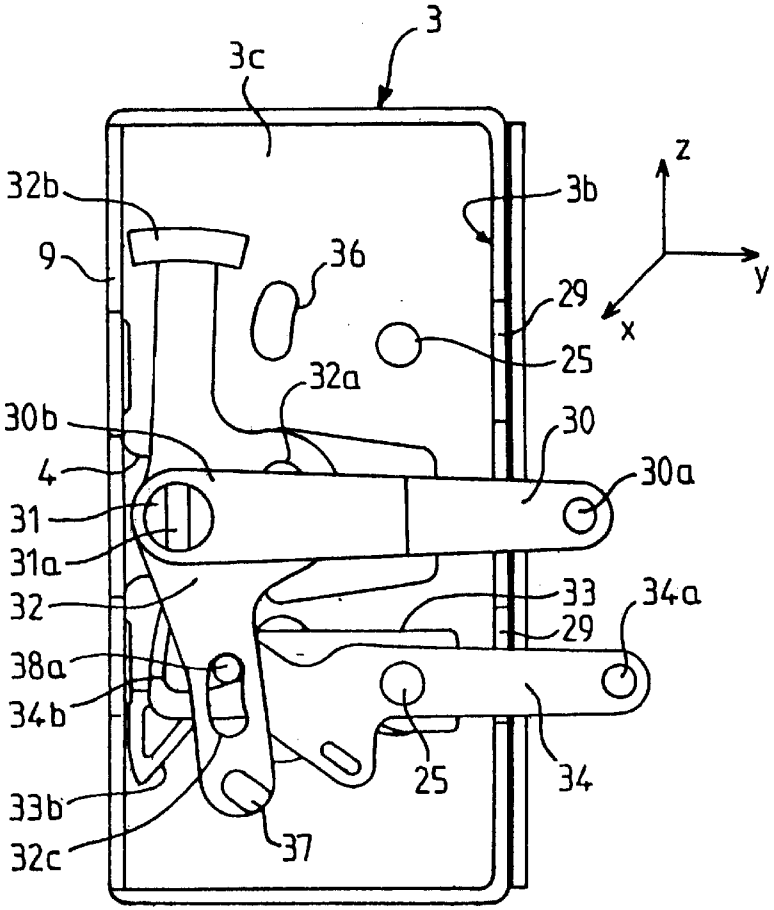
FIG. 12 is a plan view of another variant of lock according to the invention, viewed from the side of its kinematic compartment, with the parts mounted in their position for a left door.

In the variant illustrated in FIG. 12, we see part of the metal backplate 9 whose section is substantially L-shaped; its large face lies in a plane YZ and its small face lies in a plane XZ, at the end of the striker slot 4. It is advantageous that the backplate 9 has the same symmetry characteristics as the lock assembly so that it too can be mounted on a left or right door.

In this variant, the kinematic compartment 3*b* of the casing 3 contains an outside locking lever (OLL) 30 of which one end 30*a* projects from the casing where it is intended to cooperate with a lock cylinder for mechanical locking/unlocking of the lock. The other end 30*b* of the OLL 30 includes a bore for its articulation on a spigot 31 that projects on each side of the plane of a lock actuator 32. The lower spigot 31 traverses the hole 21 of the casing 3, as in FIG. 11. The lock actuator 32 has at its center an elongated opening 32*a* which engages a stud (not shown) projecting from the back of the OLL 30 to make the OLL 30 and the lock actuator 32 rotate together, with a slight degree of freedom. The lock actuator 32 includes at the end of one of its arms a toothed sector 32*b* intended to engage a pinion driven by an electric motor, for a lock with electrical locking/unlocking control. The opposite arm of the lock actuator 32 includes a circular arc-shaped hole 32*c*, which engages a stud 38*a* projecting from an intermediate lever 38 (not shown in the drawings). The intermediate lever 38 is analog to the lever 28 described previously, except that it does not have the recess 28*c*, since the dummy pawl 33 no longer includes a projecting stud but rather a bore that engages the projecting stud 17*b* of the pawl 17 illustrated in FIG. 9.

An outside opening lever (OOL) 34 is interposed between the intermediate lever 38 and the lock actuator 32; this is intended to be connected by a control rod or cable (not shown) to an outside door handle (not shown), by its end 34*a* which projects from the casing 3 through a slot 29. The OOL 34 articulates on a rotation axis 25. At its opposite end, the OOL 34 includes a slot 34*b* that is substantially L-shaped through which the stud 38*a* of the intermediate lever 38 can pass. The projecting stud 38*a* extends on each side of the plane of the intermediate lever, so as to cooperate with the dummy pawl 33. The stud 17*b* of the pawl 17 traverses a circular arc-shaped aperture 36 in the bottom 3*c* of the casing 3 to engage in the bore of the dummy pawl 33.

The lock actuator 32 also includes near its hole 32*c*, a boss 37 that extends on each side of its plane. This boss 37 cooperates with an edge face 33*b* of the dummy pawl 33, as explained later.

The projecting spigot 31 has a diametrical groove 31*a* at each of its two ends. The diametrical groove 31*a* on the side towards the retention compartment 3*a* provides a back-up means of locking (the user can pivot the spigot 31 by introducing the end of his key into this groove 31*a*, via the edge of the door).

We note that in the OOL 34 the aperture 24*d* of the OOL 24 has been eliminated, since the dummy pawl 33 no longer has a projecting stud.

The operation of the lock in FIG. 12 will now be described briefly.

In the position shown in FIG. 12, the lock is in its unlocked, closed position. When the user operates the outside door handle, the OOL 34 pivots anti-clockwise around the axis 25, which moves the stud 38*a* downwards, since this can move freely in the circular arc-shaped hole 32*c* of the lock actuator 32. The displacement of the opposite projecting part of the stud 38*a* causes the dummy pawl 33 to pivot, thereby freeing of the pawl 17 to open the lock.

When the user operates the inside door handle, an inside opening lever (not shown) cooperates with the dummy pawl 33, moving it anti-clockwise, which simultaneously drives the stud 38*a* of the intermediate lever 38.

When the latch-bolt 8 is moved into its open position, the pawl 17 is held by the latch-bolt 8 in its withdrawn position, such that the dummy pawl 33 comes into contact by its edge 33*b* against the lower boss 37 of the lock actuator 32. In this manner, the dummy pawl 33 prevents the displacement of the lock actuator 32 into its locked position, when the door is open. However, as this function is necessary only for the front driver door which is the only one equipped with a cylinder, for the front and rear passenger doors it is sufficient to use a dummy pawl having an elongated bore for its mounting on the articulation axis 25 to inhibit the locking interdiction function when the door is open.

To lock the lock, the user turns the lock actuator 32 clockwise, to bring the stud 38*a* in front of the large section of the L-shaped slot 34*b* of the outside opening lever 34. The pivoting of the lock actuator 32 can be achieved by the toothed sector 32*b*, if the lock is electrically controlled, or by the outside locking lever 30, under the action of the lock cylinder. Simultaneously, the lower boss 37 of the lock actuator 32 finds itself in contact with the edge 33*b* of the dummy pawl 33.

Therefore, when the user operates the outside door handle, the OOL 34 pivots anti-clockwise but no longer drives the stud 38*a* since this can slide freely in the large section of the L-shaped slot 34*b*.

On the other hand, when the user operates the inside door handle, the dummy pawl 33 pivots anti-clockwise and its edge 33*b* pushes the boss 37 of the lock actuator 32, thereby moving it into its unlocked position. We therefore achieve automatic unlocking during the opening from the inside, this operation being known as "override". The switching of the lock actuator 32 between its locked position and its unlocked position, during override, is possible thanks to the arc-shaped slot 32*a* in the lock actuator 32, such that the OLL 30 is not displaced during automatic unlocking on opening.

Figure 13:
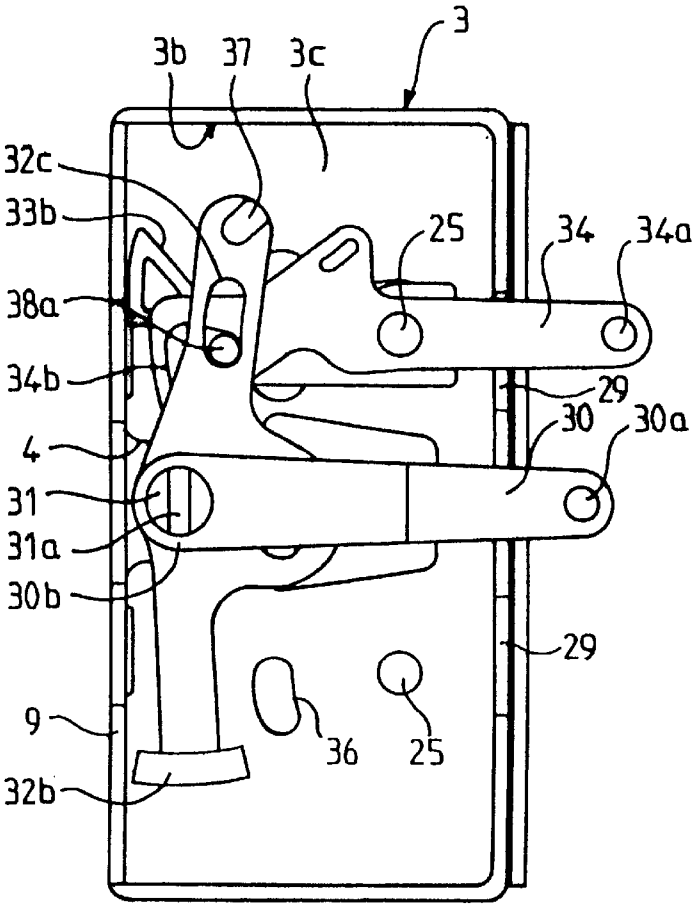
FIG. 13 is a view similar to that of FIG. 12, with the parts mounted in their position for a right door.

FIG. 13 represents the same casing 3 and the same parts in the kinematic compartment, but positioned for a right door lock.

The casing 3 has a plane of symmetry in XY; the circular arc-shaped aperture 36 and the axis 35 are duplicated, on each side of this plane.

The OOL 34, the lock actuator 32, the dummy pawl 33 and the intermediate lever 38 all have a plane of symmetry parallel to their mounting plane, such that they can be used for a left lock or a right lock, by turning them over. The OLL 30 has a plane of symmetry perpendicular to its mounting plane, so it can be used in the same position for a left or right lock.

Although the invention has been illustrated by certain embodiments, it is in no way limited to these, and it will be clear to professionals of the art that numerous technical variants are possible while remaining within the framework of the invention.

What is claimed is:

1. A lock for a door of an automobile vehicle defining longitudinal, transverse and vertical directions and a vertical transverse plane, a longitudinal vertical plane and a longitudinal horizontal plane comprising a lock casing having a retention compartment containing retention parts and a kinematic compartment containing control parts said compartments providing, for the retention and control parts, mounting planes parallel to the vertical transverse plane of the vehicle, said retention compartment including a striker slot opening in the transverse direction for receiving a striker during door closing, wherein the casing has a plane of symmetry parallel to the longitudinal vertical plane or to the longitudinal horizontal plane when mounted on the vehicle, to enable use of the casing for either a left door or a right door, and at least one of said retention parts has a plane of symmetry perpendicular to the mounting plane, to enable use of said part in either a left door lock or a right door lock, by rotating said part through an angle between 0° and 180° about an axis parallel to the longitudinal direction, and a pawl having an axis of rotation, said pawl being anchor-shaped with two lateral hooks positioned on opposing sides of said pawl.

2. A lock according to claim 1, wherein at least one of said retention and control parts have a plane of symmetry parallel or perpendicular to their mounting plane, to enable use of said parts in a left door lock or a right door lock.

3. A lock according to claim 1, wherein said casing has a plane of symmetry that passes through an axis (A) of said striker slot, to enable use of the casing for a left door or a right door, by rotating said casing through an angle of 180° about an axis parallel to the longitudinal direction when mounted on the vehicle.

4. A lock according to claim 3, wherein said retention compartment includes a latch-bolt defining a first articulation axis and a pawl defining a second articulation axis, said articulation axes being positioned symmetrically with respect to said axis of said striker slot, to enable inverted mounting of said latch-bolt and said pawl on said articulation axes, depending on whether the lock is intended for a left door or a right door.

5. A lock according to claim 3, wherein said casing includes maneuvering apertures for said control parts and wherein said articulation axes and the maneuvering apertures are positioned symmetrically with respect to the plane of symmetry of said casing, to enable mounting of said control parts on a side of the plane of symmetry, depending on whether the lock is intended for a left door or a right door.

6. A lock according to claim 1, wherein said casing has a plane of symmetry, said striker slot opening in the transverse direction on two opposite sides of said casing, enabling said casing to be mounted in the same position on a left door or a right door.

7. A lock according to claim 6, wherein said retention compartment includes a latch-bolt defining a first articulation axis and a pawl defining a second articulation axis and wherein said articulation axes lie in the plane of symmetry of said casing, so that said latch bolt and said pawl remain mounted on their respective articulation axes, whether the lock is intended for a left door or a right door.

8. A lock according to claim 1, wherein said at least one retention part is a fork shaped latch bolt having an axis of rotation, and a plane of symmetry perpendicular to said axis of rotation, said latch bolt having two branches positioned symmetrically with respect to said latch bolt plane of symmetry.

9. A lock according to claim 1 which further comprises a lock actuator having an axis of rotation and having two arms that extend substantially perpendicularly and symmetrically with respect to the plane of symmetry of said casing, said plane passing through the axis of rotation of said lock actuator.

10. A lock according to claim 1, wherein at least one of said retention compartment or kinematic compartment has a plane of symmetry parallel to its mounting plane, to enable use of said part in either a left door lock or a right door lock, by rotating the part through 180° about an axis parallel to the transverse or vertical direction.

11. A lock according to claim 1, wherein the casing is mounted on an L-section metal backplate having a large face that lies substantially in a plane parallel to the mounting transverse vertical plane and having a small face that lies substantially in a plane parallel to the longitudinal vertical plane when mounted on the vehicle, at the end of the striker slot, the backplate having the same plane of symmetry as the casing.

* * * * *